US007520005B2

(12) United States Patent
Barthelt

(10) Patent No.: US 7,520,005 B2
(45) Date of Patent: Apr. 21, 2009

(54) ROTATING, SITTING-UP BED COMPRISING A THIGH-RAISING DEVICE

(76) Inventor: Hans-Peter Barthelt, Hegensberger Strasse 132, Esslingen (DE) 73732

( * ) Notice: Subject to any disclaimer, the term of this patent is extended or adjusted under 35 U.S.C. 154(b) by 242 days.

(21) Appl. No.: 10/563,771

(22) PCT Filed: Jun. 21, 2004

(86) PCT No.: PCT/EP2004/006680

§ 371 (c)(1),
(2), (4) Date: May 15, 2006

(87) PCT Pub. No.: WO2005/002486

PCT Pub. Date: Jan. 13, 2005

(65) Prior Publication Data

US 2006/0236458 A1 Oct. 26, 2006

(30) Foreign Application Priority Data

Jul. 7, 2003 (DE) ..... 103 30 759

(51) Int. Cl.
*A61G 7/10* (2006.01)

(52) U.S. Cl. ..... 5/618; 5/624

(58) Field of Classification Search ..... 5/612, 5/613, 618, 624
See application file for complete search history.

(56) References Cited

U.S. PATENT DOCUMENTS

| | | | | | |
|---|---|---|---|---|---|
| 3,112,500 | A * | 12/1963 | MacDonald | ..... | 5/618 |
| 3,239,853 | A * | 3/1966 | MacDonald | ..... | 5/616 |
| 4,183,109 | A * | 1/1980 | Howell | ..... | 5/618 |
| 4,862,529 | A * | 9/1989 | Peck | ..... | 5/611 |
| 5,095,561 | A * | 3/1992 | Green et al. | ..... | 5/618 |
| 5,425,151 | A * | 6/1995 | Iura | ..... | 5/618 |
| 5,497,518 | A * | 3/1996 | Iura | ..... | 5/618 |
| 5,577,279 | A * | 11/1996 | Foster et al. | ..... | 5/618 |
| 6,912,746 | B2 * | 7/2005 | Grove | ..... | 5/618 |
| 7,086,103 | B2 * | 8/2006 | Barthelt | ..... | 5/613 |

* cited by examiner

*Primary Examiner*—Michael Trettel
(74) *Attorney, Agent, or Firm*—Leydig, Voit & Mayer, Ltd.

(57) ABSTRACT

A rotating and sitting-up bed includes a height-adjustable base and a support frame, which is connected to the base by means of a rotating articulated element. The support frame can be rotated by 90 degrees relative to the vertical axis with the help of the rotating articulated element. The support frame is divided into a back section, a center section, a thigh section, and a lower-leg section. In the rotated position, the support frame can fold into a Z shape, wherein the back part projects upwards starting from the center section and the lower-leg part hangs downwards from the thigh part. In addition, a crank mechanism ensures that the thigh part is raised by a few cm at its front edge, which is adjacent to the back of the knee of the patient.

9 Claims, 5 Drawing Sheets

ROTATING, SITTING-UP BED COMPRISING A THIGH-RAISING DEVICE

FIELD OF THE INVENTION

The present invention related generally to sleeping beds, and more particularly, to a sleeping bed that can be automatically converted from a normal sleeping position into a chair position.

BACKGROUND OF THE INVENTION

From DE 102 00 408 C1, a rotating bed is known which is designed to bring a patient lying in the bed into a sitting position at the edge of the bed. For this purpose, the known bed has a height-adjustable base, which carries a rotating articulated element. A support or mattress frame is connected to the base by means of the rotating articulated element and can be rotated from the normal bed position, in which the longitudinal axis of the mattress frame coincides with the longitudinal axis of the bed, into a cross-wise position.

The support frame is assembled from several sections so that it can be folded Zshaped like a chair or recliner in the cross-wise rotated position. In the chair or recliner shape, the support frame forms a backrest, a sitting surface, and a section which hangs downwardly and which supports the lower legs when in the bed position. The sitting surface itself has two parts comprising a center part connected rigidly to the swivel articulated element and a thigh part, which is hinged to this center part and is disposed between the center part and the lower leg part.

In the sitting position of the known bed, the center part and the thigh section extend horizontally. The mattress, which has a considerable thickness, is pulled over the edge between the thigh part and the lower leg part in the chair or recliner position, producing a falling "chair edge." This is not bothersome in the known rotating bed because the sitting depth relatively large. Decreasing the sitting depth, however, can cause the patient to feel unsafe in a sitting position, especially if the mattress is not made from viscose foam.

OBJECTS AND SUMMARY OF THE INVENTION

It is an object of the invention to provide a sitting-up bed that does not cause the patient to feel unsafe in the sitting position even when the bed had reduced sitting depth.

The novel sitting-up bed according to the invention has a thigh part connected to a center part by means of a hinge such that when the bed is in the sitting position, the seat area of the patient lies approximately above the center part, while the thigh up to the back of the knee lies on the thigh part. Furthermore, means are provided to further lift the thigh part in the vicinity of the back of the knee in the recliner or chair position. In this way, the center part forms a flat depression together with the thigh part. This depression remains even when a mattress material is used that is not suitable for generating such a depression, resulting a feeling of safety to the user when in the sitting position.

The resulting flat sitting depression, which is bounded behind the patient by the back part, enables the distance between the bend at which the back part transitions into the sitting surface to the bend where the sitting surface is bent downwards at the front edge, to be shortened, without making the patient feel unsafe in the sitting position. On the other hand, the shortened sitting surface considerably simplifies patient transfer from the bed to a wheelchair for the care provider, and without additional mechanical aids.

Patients who can still stand up themselves when they are brought into the sitting position by the bed also benefit from the shortened sitting surface, which simplifies standing up.

Nevertheless, patients still feel safe in the sitting position, as already mentioned, if they do not want to leave the bed from the sitting position.

Easier standing up is enabled because the free edge of the sitting surface is displaced significantly in the direction towards the seat area from the back of the knee. This also means a displacement of any line over which the thigh of the patient seesaws when standing up into the upright position. The farther this point is displaced towards the seat area, the easier is the standing up process. Conversely, the process becomes harder the closer this point is to the back of the knee.

Without the countermeasure according to the invention, a displacement of this contact point towards the seat area would mean the patient would feel unsafe in the sitting position, especially for patients with handicaps that are significantly limited in the use of muscle force.

A very simple and reliable measure for pivoting the thigh part into the sitting position arises from the use of cam mechanics. In the simplest case, these cam mechanics can be connected to a lever arrangement that is used to pivot and to raise the lower leg part.

A very simple solution further arises from using an intermediate frame, in which a shaft is supported so that it can rotate. The shaft carries on one side a lever for pivoting the lower leg part, and on the other side, cams for raising the thigh part.

The stability of the arrangement is improved when the thigh part has a cross strut, which is located at the height of the cam and which is simultaneously used as a counter surface for the cam. This enables very uniform raising of the thigh part. In particular, twisting is prevented when the patient sits asymmetrically on the thigh part of the mattress frame.

Other objects and advantages of the invention will become apparent upon reading the following detailed description and upon reference to the drawings, in which:

Figure 1:
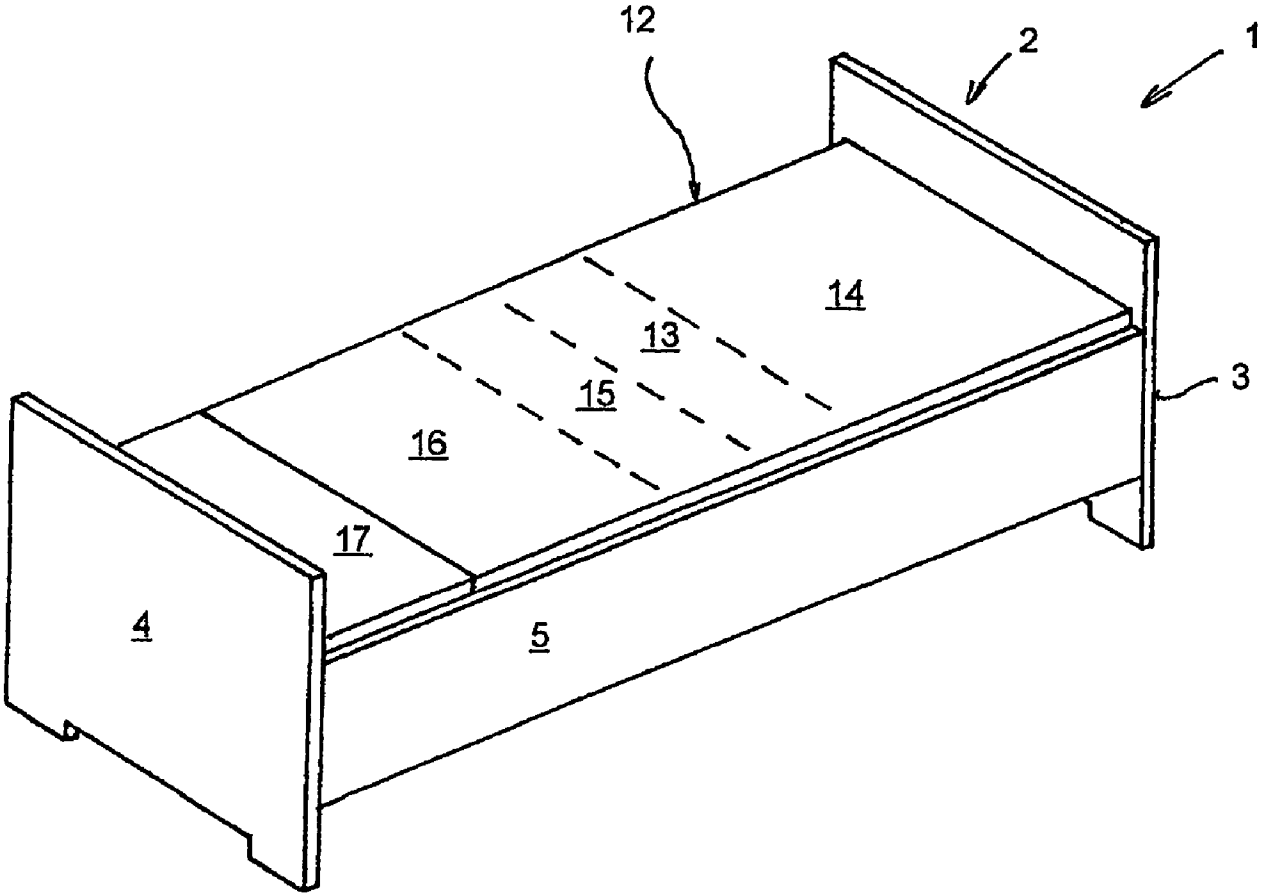
FIG. 1 is a perspective of a rotary bed in accordance with the invention, shown in a sleeping position.

While the invention is susceptible of various modifications and alternative constructions, a certain embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENTS

Figure 2:
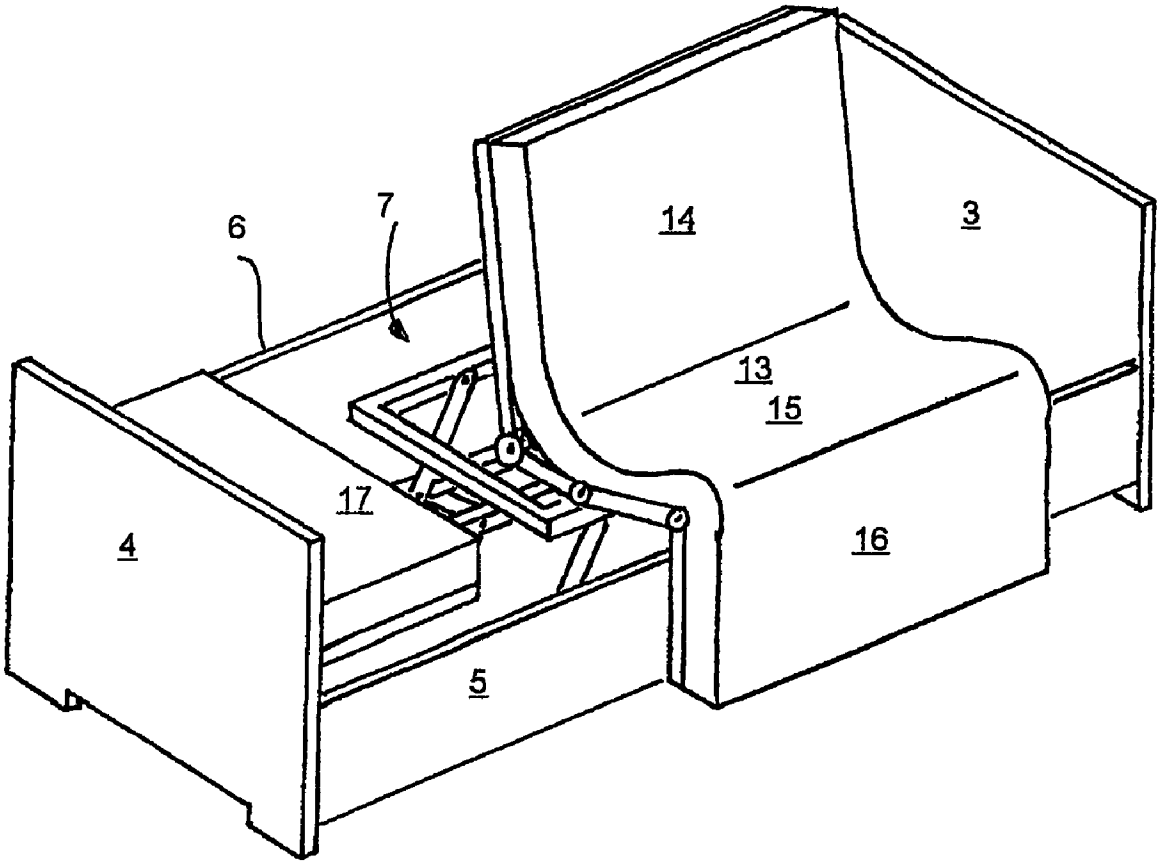
FIG. 2 is a perspective of the rotating bed shown in FIG. 1, after being rotated and raised into a sitting up or chair position.

Referring now more particularly to FIGS. 1 and 2 of the drawings there is shown an illustrative rotating bed 1 embodying the present invention. The illustrated rotating bed 1 includes a bed surround 2 with a head part 3, a foot part 4, and front and rear side walls 5, 6, respectively as viewed in FIG. 1. The front side wall 5 is supported a distance from the floor such that a gap is produced between the bottom edge of the side wall 5 and the floor which enables a care provider to place the tips of his feet under the bed. The side wall 5 is supported so that it can move, and in the reclining position of the bed 1 is moved downwardly, as shown in FIG. 2. The moveable support of the side wall 5 is disclosed in detail, for example, in DE 199 12 937 A1.

Figure 3:
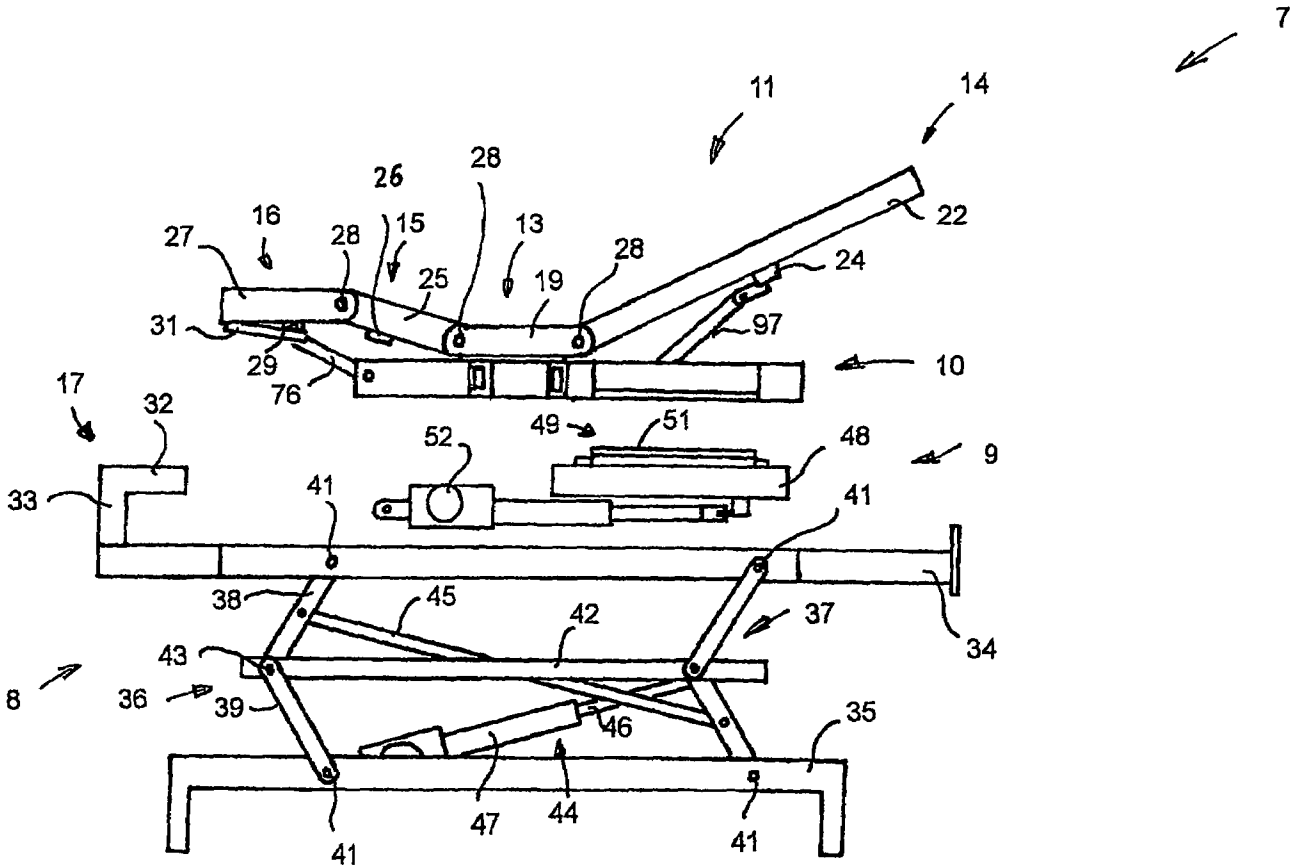
FIG. 3 is an exploded view of the illustrated bed.

Within the bed surround 2 there is a bed frame 7, as seen in FIGS. 2 and 3. The bed frame 7 includes a height-adjustable base 8 having a rotating articulated element 9 with a vertical rotational axis is mounted on a top side thereof, an intermediate frame 10, and a mattress support frame 11 on which a mattress 12 is located. The support frame 11 is rectangular when viewed from above.

The support frame 11 is divided into a center section 13, which is connected rigidly to the intermediate frame 10, a back section 14 which is hinged to the center section 13, a thigh section 15 which is hinged to the center section 13, and a lower-leg section 16. The lower-leg section 16 is hinged to the end of the thigh section 15 remote from the center section 13. The hinge axes about which the sections 14, 15, 16 can move relative to the center section 13 are horizontal. Finally, the support frame 11 also includes a foot section 17.

Figure 4:
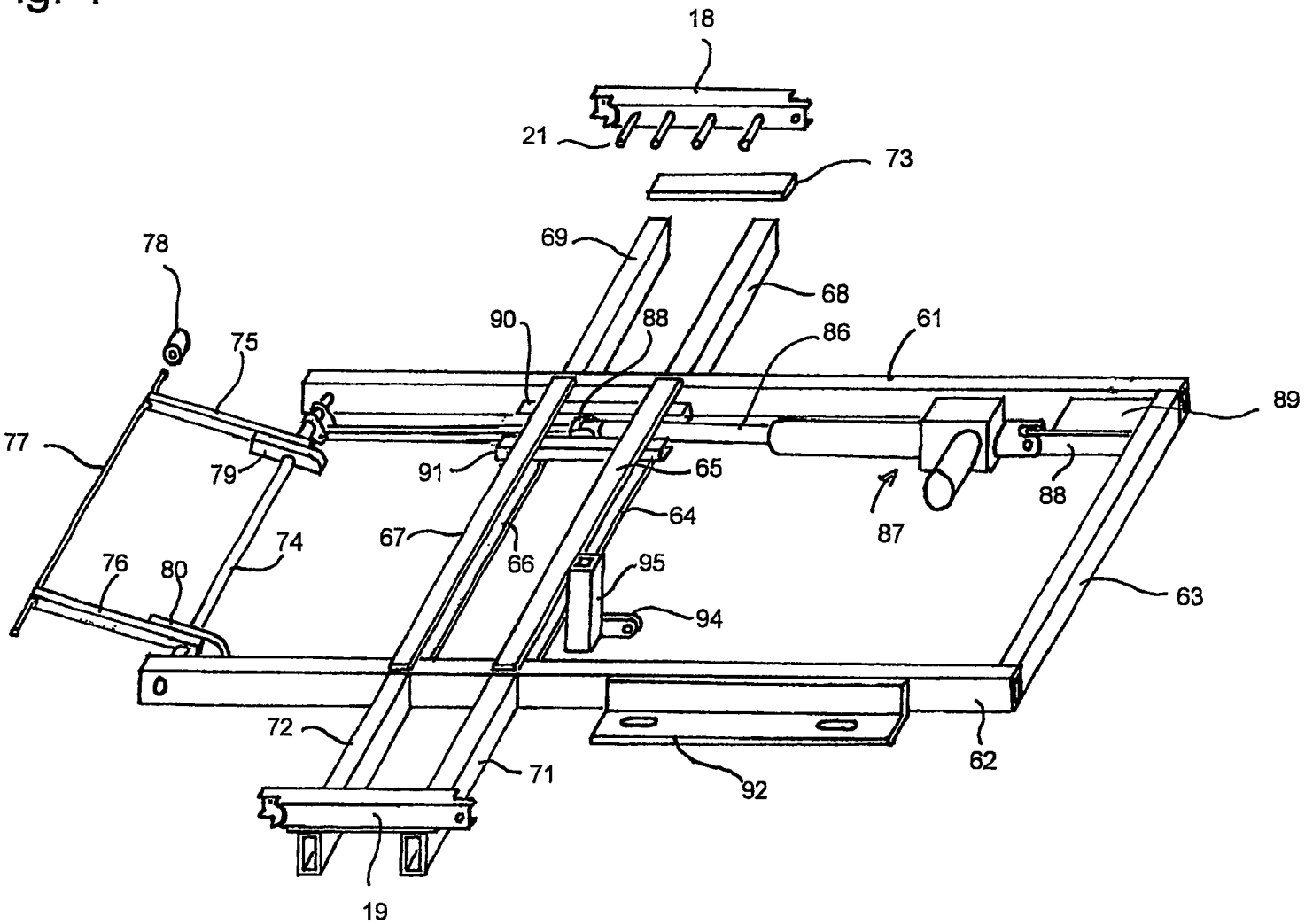
FIG. 4 is a perspective of the intermediate frame of the illustrated bed.
Figure 5:
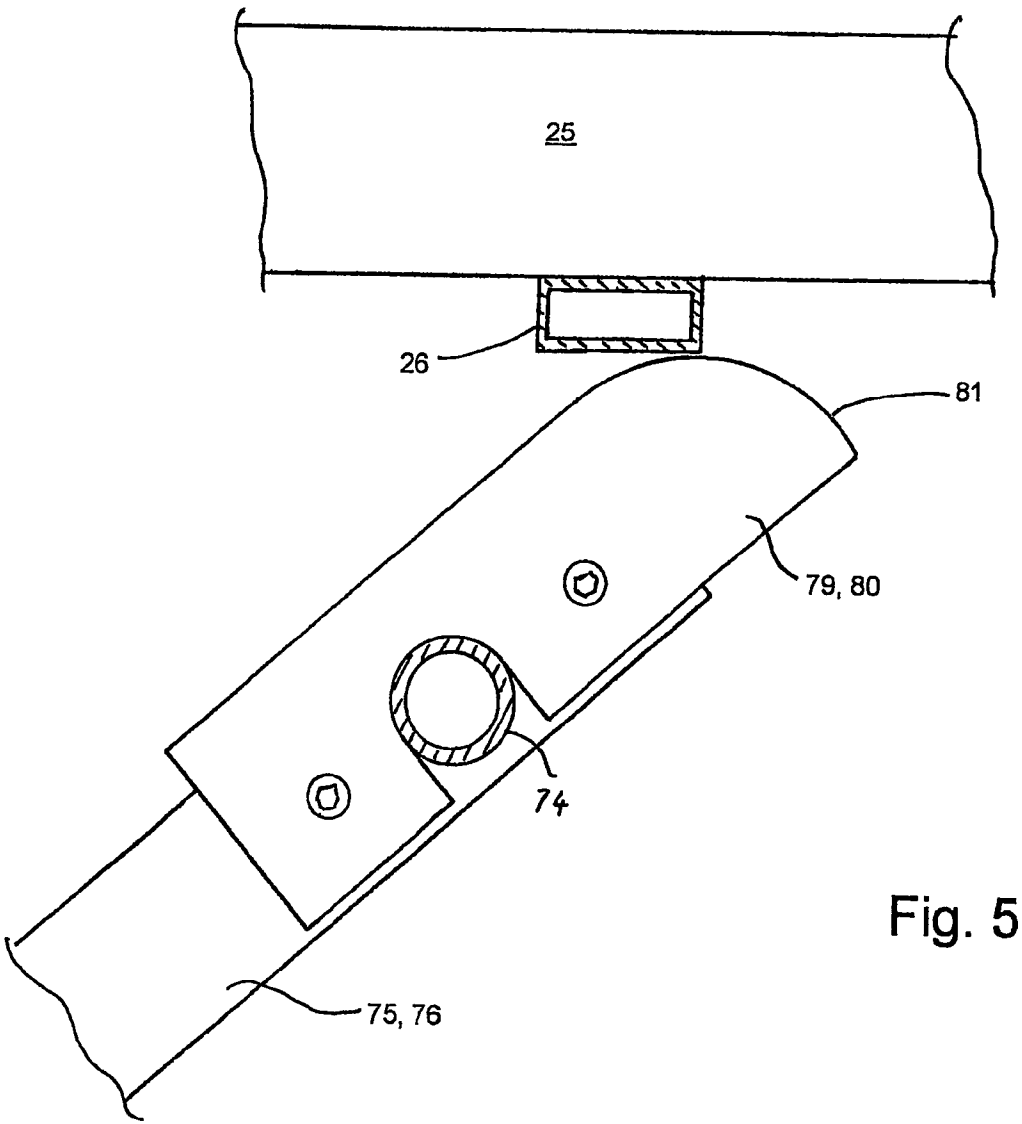
FIG. 5 is an enlarged fragmentary vertical section of the intermediate frame of the illustrated bed.

The center section 13 of the support frame 11 has two parallel longitudinal side rails 18, 19, which can be seen in FIG. 4. Each of these side rails 18, 19 ends at a bracket for a hinge. Each side rail 18, 19 carries inwards pointing pegs 21 on which molded rubber parts are pushed, which hold spring bars in a known way. Instead of spring bars, a plate could be used as the contact point, which is typical for hospital beds.

The back section 14 is bordered by side rails 22 which are hinge connected to the longitudinal side rails 18, 19. The two side rails 22 of the rear section 14 are connected to each other at the top end by means of an appropriate cross strut and another cross strut 24 extends between the two side rails 22 at a lower location. The thigh section 15 also is bordered by two longitudinal side rails 25, which are connected by means of a cross strut 26.

Finally, the lower-leg section 16 also is bordered by two longitudinal side rails 27, which are connected to each other at the bottom end by means of a cross strut. In addition to this strut, the two longitudinal side rails 27 are connected by a strut 29 to which the two parallel guide rails 31 are mounted which extend up to the foot end. They extend, as shown, at an angle to the longitudinal side rail 27 such that they converge in the direction towards the foot end. The separation of the two guide rails 31 is significantly smaller than the separation of the two longitudinal side rails 27. Relative to these parts, the guide rails 31 are offset by approximately 20 cm to the inside. The foot section 17 consists of side rails 32, which are erected on the base 8 by means of struts 33.

All of the longitudinal side rails 22, 25, and 27 carry pegs pointing towards the center of the bed, corresponding to the pegs 21, which carry molded rubber parts between which spring bars extend in a known way.

Adjacent side rails are connected to each other by means of joints 28 with horizontal axes. The axes of corresponding side rails are coaxial with each other on the two sides of the bed 1. The sections 13, 14, 15, 16 of the support frame 11 correspond to sections of the mattress 12, which are shown separated by dash-dot lines.

The height-adjustable base 8 includes an upper rectangular frame 34 and also a lower rectangular frame 35, which are connected to each other by means of a total of five toggle-joint pairs 36, 37. The toggle-joint pairs 36, 37 are each located on respective longitudinal sides of the base 8. Each toggle-joint pair 36, 37 is assembled from an upper toggle lever 38 and a lower toggle lever 39. Each toggle lever 38, 39 is connected in an articulating way to the upper and lower frame 34, 35, respectively, by means of a joint 41 having a horizontal axis on the associated bed side. All of the axes of the joints 41 are axis-parallel to each other. The axes of joints 41 on a front side of the frame are coaxial with the axes of the joints 41 of the toggle joint 38, 39 an the opposite rear side.

The two toggle-joint pairs 36, 37 on each side of the base 8 are coupled to each other by an associated coupling strut 42. Each coupling strut 42 is connected, as shown, to the knee joint 43 of each toggle-joint pair 36, 37 in an articulated way. Finally, the two coupling struts 42 further are connected to each other like a yoke by means of an appropriate cross strut that cannot be seen. A drive motor 44 supported on the lower frame 35 engages the cross strut. Finally, on each side of the base, legs of diagonal coupling struts 45 connect the upper toggle lever 38 of the toggle-joint pair 36 to the lower toggle lever 39 of the toggle-joint pair 37. The kinematics of the base 8 and its dimensioning are disclosed in detail in DE 198 54 136 A1, the disclosure of which is incorporated by reference.

The drive motor 44 can be a commercially available spindle motor. Worm gearing can be driven by the motor which in turn is connected free of rotational play with a screw spindle which has a threaded nut that moves on the screw spindle. A lifting tube 46, which runs coaxially in a guide tube 47, is attached to the threaded nut in a tension-proof and compression-proof way.

By operating the motor in the appropriate rotational direction, the lifting tube 46 is either retracted into the guide tube 47 or pushed out of the guide tube. When the lifting tube 46 is pushed, the cross strut, which connects the coupling struts 42 to each other, moves in the direction of the head of the bed. In this way, the lower toggle level 39 of each of the toggle-joint pairs 36, 37 is raised, because all of these parts are connected to each other kinematically by means of coupling struts.

The kinematics guarantee that the upper frame 34 is always parallel to the lower frame 35. The vertical movement of the upper frame 34 also results in no significant displacement of the upper frame 34 in the longitudinal direction of the bed 1 within the lifting range for which the base 8 is constructed, with resulting longitudinal movement being less than 5 mm.

The rotating articulated element 9 includes a ring 48 and also a rotating carrier 49 running in the ring 48. The ring 48 is fixed in the upper frame 34. The rotating carrier 48 includes two longitudinal side rails 51. The two longitudinal side rails 51 are parallel to each other. The rotating carrier 49 can be rotated back and forth by 90° by means of a drive motor 52, which may be similar to the drive motor 44. When the rotating carrier 49 rotates, the reaction moment of the drive motor 52 is directed to an abutment which is provided on the upper frame 34.

The intermediate frame 10, as shown in FIG. 4 includes two longitudinal side rails 61, 62, which are connected to each other by means of a head-side cross strut 63. In addition, the two longitudinal side rails 61, 62 are connected to each other, at the location of the longitudinal side rails 18, 19 of the center section 13 of the support frame 11 by means of a total of four struts 64, 65, 66, and 67. In this way, a type of open box profile is provided that is adapted to absorb forces originating from outwardly extending brackets 68, 69, 71, and 72 when the support frame 11 is loaded with a patient, without torsion and expansion of the distance between the longitudinal side rails 61, 62 in the region of the struts 64, 67.

The brackets 68, 72 are welded projecting outward on the outer side of the two longitudinal side rails 61, 62 as shown, such that the two brackets 68, 71 align with each other just like the two brackets 69, 72. The longitudinal axes of these pairs of brackets 68, 72 are parallel to each other. Their length is approximately 20 cm, and they carry the side rails 18, 19 set rigidly and immovably on the free projecting ends with a spacer 73 arranged in-between. In this respect, the brackets 68,72 form the mechanically fixed connection between the support frame 11 and the intermediate frame 10.

To drive the thigh section 15 and also the lower-leg section 16, there is a shaft 74 supported at the foot end between the two longitudinal side rails 61, 62. Parallel arms 75, 76, which are fixed relative to each other and which are connected to each other at their free ends by a cylindrical strut 77, are mounted on this shaft 74. The strut 77 projects past the arms 76, 75, with projecting ends each supporting pegs for two cylindrical rolls 78, of which only one is shown. The two rolls 78 run in the guide rails 31 and support the lower-leg section 16 at the corresponding position.

Towards the other side, the arms 75, 76 project past the shaft 74 and are used as attachment points for two cam parts 79, 80. The cam parts 79, 80 each have a cam surface 81, which runs part way around the shaft 74 approximately in a spiral shape. The cam surfaces 81 interact with the strut 26 on the lower side of the thigh part 15, as will become apparent below.

To turn the shaft 74 and thus to raise the levers 75, 76, another lever pair, which is used as an attachment point for a connecting rod 85 is provided on the shaft 74. The connecting rod 85 is connected to a lifting tube 86 of a drive motor 87. The structure of the drive motor 87 corresponds to the structure of the drive motor 44. The longitudinal axis from the composite body of the connecting rod 85 and lifting tube 86 runs parallel to the longitudinal side rail 61 in the top view, and adjacent to the longitudinal side rail 61 on its inner side. The motor 87 is supported on a bracket 88 which is reinforced relative to the longitudinal side rail 61 by means of an insert 89. The connection between the connecting rod 85 and the lifting tube 86 is hinge-like. To prevent buckling, the lifting tube 86 is guided in the region of the coupling point with the connecting rod 85. To this end, two short U-shaped guide rails 90, 91 are fixed on the two lower struts 64, 66. The two U-shaped guide rails 90, 91 open in the direction towards each other and lie at the same height.

A fork head 88*a*, which grips over the free end of the lifting tube 86 from the outside, is mounted on the connecting rod 85. An axle bolt on which two rolls are supported so that they can rotate outside of the fork head 88*a* is guided through aligned bore holes in the fork head 88*a* and the end of the lifting tube 86. The rolls run in the guide rails 90, 91. Thus, buckling of the connection point between the fork head 88 and the lifting tube 86 is effectively prevented.

The attachment of the intermediate frame 10 on the rotating carrier 48 is carried out with the help of two angled flanges 92, of which only one can be seen in FIG. 4 due to the perspective. The angled flanges 92 each have one leg welded to the outer side of the respective longitudinal side rails 61, 62, while their other legs are flush with the bottom side of the corresponding longitudinal side rail 61, 62.

Finally, on the two cross struts 64, 65 there is a motor abutment 94, which is mounted on a column 95 projecting downwards. The column 95 is attached with a flat side to the two struts 64, 65. In the assembled state, it projects into the space of the rotating carrier 48. A motor is similar to motor 44 is hinged to the motor abutment 94. This motor, only its lifting tube 97 of which can be seen, is supported on the strut 24 in order to selectively raise or lower the back part 11.

In the following explanation of the function of the bed will start with the bed in the lying-down position shown in FIG. 1. In this position, the base 8 is moved together to a maximum, i.e., with the lifting tube 46 being retracted in the guide tube 47. The toggle-joint pairs 36, 37 are folded together to a maximum with intermediate frame 10 lying in the longitudinal direction of the bed 1. The back section 14 is lowered and lies with its cross strut 24 on the longitudinal side rails 61, 62 of the intermediate frame 10. Through corresponding activation of the drive motor 87, the levers 75, 76 are brought into a position in which the lower leg section 16 runs in a straight extension of the back section 14 or the foot section 17. In this position, the non-self-actuated thigh section 15 also lies with its strut 26 on the two longitudinal side rails 61, 62.

The patient can selectively raise the back section 14. For this purpose, he sets the corresponding drive motor in gear by means of a hand control. Its lifting tube 97 is moved outwards and presses the back section 14 upwards.

The lower-leg section 16 is raised when the user sets the motor 87 in gear. The lifting tube 86 is moved outwardly and pushes the connecting rod 85 in the direction towards the shaft 74. This is turned in order to pivot the levers 75, 76 upwards and to press the lower-leg part 16 up. Through suitable stops in the guides 31, the lower-leg section 16 is simultaneously pulled towards the center section 13 when the levers 75, 76 pivot upwards. Consequently, the thigh section 15 is also arranged diagonally upwards, as shown in FIG. 3.

If the patient would like to be brought by the bed 1 into a position similar to a healthy person sitting on the edge of the bed, he first brings the lower leg and the thigh sections 15, 16 into the position according to FIG. 3. In addition, the back section 14 is brought into a position of approximately 45°, so that for subsequent rotating, there is no excessive projection past the outlines of the bed. As soon as the support frame 11 has been adjusted accordingly, the base 8 moves up until the bottom side of the intermediate frame 10 can rotate freely over the upper edge of the two side walls 5, 6.

When this position is reached, the lifting motor 57 is stopped and the rotary motor 97 assigned to the rotating articulated element 9 is set in gear. Its lifting tube moves in and turns the intermediate frame 10, together with the support frame 11 located on this frame, by 90° either to the left or to the right, depending on which abutment the rotary motor 97 is articulated to.

As soon as the final rotating position has been reached, the lifting motor 57 is set in gear again in order to move the base 8 together into its smallest arrangement. For the downwards movement, the bottom side of the intermediate frame 10 engages with the top side of the side wall 5 and presses it downwards.

After reaching the bottom-most position, the motor 87 is set in gear, such that the lifting tube 86 is pulled into the associated guide tube. This movement pulls the connecting rod 83 back, whereby the levers 75, 76 are pivoted downwards. This downwards pivoting of the levers 75, 76 has the effect that the foot section is also pivoted downwards until it reaches the final position from FIG. 2. When the shaft 74 rotates, the cam parts 79, 80 are turned upwards and engage with the strut 26. Due to the profile of the cam surface 81, continued rotation raises the strut 26, which pivots the thigh part 15 upwards about the joint between the side rails 25 and 19. In the final position, the thigh part 15 is raised in the region of the back of the knee of the patient by approximately 2 cm to 5 cm. A flat sitting depression is produced which helps the patient to feel safe in the sitting position.

When the lower-leg part 16 is raised again, the cam parts 79, 80 rotate downwards away from the strut 26. The thigh part 15 is lowered into the horizontal position. Finally, the patient can adjust the back section 14 more or less steeply as desired.

As will be understood by a person skilled in the art, the length of the lower-leg section 16 in the chair or recliner position, measured starting at the upper edge of the mattress 12, may not be longer than the length of the lower leg for a normal sized person. Otherwise, a person could not reach the floor with the soles of his feet. The proportioning of the thigh section 15 and lower-leg section 16 must be adapted to human anatomy. For the normal lying-down position, the lower-leg section 16 would be too short, which is why the foot section 17 is provided, which carries a separate mattress section.

With the help of the bed 1, a patient can be brought from the lying-down position into a sitting position perpendicular to the bed without any exertion by himself and without having to rely on the help of a care provider. He can also be brought back from this position into the lying-down position by performing the sequence of movements described above in reverse.

From the foregoing, it can be seen that the rotating and sitting-up bed is assembled from a height-adjustable base and a support frame, which is connected to the base by means of a rotating articulated element. With the help of the rotating articulated element, the support frame can be rotated by 90 degrees relative to the vertical axis. The support frame is divided into a back section, a center section, a thigh section, and a lower-leg section. In the rotated position, the support frame can fold into a Z shape, wherein the back part extends upwards starting from the center part, and the lower-leg part hangs downwards from the thigh part. In addition, by means of a crank mechanism, the thigh part is raised by a few cm at its front edge, which is adjacent to the back of the knee of the patient.

The invention claimed is:

1. A hospital sitting-up bed (1) comprising a height-adjustable base (8), a support frame (11) having a center part (13), a back part (14) connected to the center part (13), a thigh part (15) connected to the center part (13), and a lower-leg part (16) connected to the thigh part (15), said center part (13) being connected to said back part (14) and thigh part (15) and said thigh part (15) being connected to said lower-leg part (16) by respective pivot joints (28) each having a horizontal joint axis, at least one drive (87, 97) for pivoting said parts of the support frame (1) relative to each other such that in one position they assume a configuration of a horizontal bed and in another position they assume a position similar to a chair in which said lower-leg part (16) extends downwards, and an actuating device (79, 80, 26) operable by said at least one drive for moving said thigh part into a position in which it extends diagonally upwardly in a direction toward the lower leg part (16) starting from the center part (13) when said parts are moved to the configuration similar to a chair, said actuating device (79,80,26) including a cam mechanism for pivoting said thigh part upwardly as an incident to movement of said lower leg part downwardly toward the configuration similar to a chair and for retaining it in that position when the parts are in the configuration similar to a chair.

2. The hospital sitting up bed according to claim 1 including a rotable articulated element (9) mounted on said base 8 and having a vertical axis, said support frame (11) being supported on said rotatable articulated element (9) for relative rotational movement.

3. A hospital sitting-up bed (1) comprising a height-adjustable base (8), a support frame (11) having a center part (13), a back part (14) connected to the center part (13), a thigh part (15) connected to the center part (13), and a lower-leg part (16) connected to the thigh part (15), said center part (13) being connected to said back part (14) and thigh part (15) and said thigh part (15) being connected to said lower-leg part (16) by respective pivot joints (28) each having a horizontal joint axis, at least one drive (87, 97) for pivoting said parts of the support frame (1) relative to each other such that in one position they assume a configuration of a horizontal bed and in another position they assume a position similar to a chair in which said lower-leg part (16) extends downwards, an actuating device (79, 80, 26) operable by said at least one drive for moving said thigh part into a position in which it extends diagonally upwardly in a direction toward the lower leg part (16) starting from the center part (13) when said parts are moved to the configuration similar to a chair, said actuating device including a shaft (74) on said lower leg part which extends perpendicularly to a longitudinal axis of said support frame (11), at least one cam (79, 80) fixedly mounted on said shaft (74), and said at least one drive being operable for rotating said shaft (74) and pivoting said cams (79, 80) to move said thigh part relative to said lower leg part.

4. The hospital sitting up bed according to claim 3 in which said actuating device includes a drive motor (87) for rotating said shaft (74).

5. The hospital sitting up bed according to claim 4 in which said drive motor is operable for pivoting said lower leg part (16) about a pivot axis transverse to a longitudinal axis of said support frame.

6. The hospital and sitting-up bed of claim 3 in which said thigh part (15) has a bottom strut (26) extending transversely along an underside thereof defining a counter caming surface for engagement by said at least one cam (79, 80).

7. The hospital and setting up bed of claim 6 in which said shaft (74) is supported by said intermediate frame.

8. A hospital sitting-up bed (1) comprising a height-adjustable base (8), a support frame (11) having a center part (13), a back part (14) connected to the center part (13), a thigh part (15) connected to the center part (13), and a lower-leg part (16) connected to the thigh part (1 5), said center part (13) being connected to said back part (14) and thigh part (15) and said thigh part (15) being connected to said lower-leg part (16) by respective pivot joints (28) each having a horizontal joint axis, at least one drive (87, 97) for pivoting said parts of the support frame (1) relative to each other such that in one position they assume a configuration of a horizontal bed and in another position they assume a position similar to a chair in which said lower-leg part (16) extends downwards, an actuating device (79, 80, 26) operable by said at least one drive for moving said thigh part into a position in which it extends diagonally upwardly in a direction toward the lower leg part (16) starting from the center part (13) when said parts are moved to the configuration similar to a chair, a shaft (74) rotatably supported transversely in said support frame, said shaft (74) having levers (75, 76) fixed in outwardly extended relation thereto which interact with said lower leg part (16) in order to bring the lower leg part (16) from a downward hanging position into a generally horizontal position, and at least one cam plate (79, 80) mounted in fixed relation to said transverse shaft (74) and levers (75, 76) for interacting with and pivoting said thigh part.

9. The rotating and setting up bed of claim 8 in which said bed includes an intermediate frame (10) mounted on said height adjustable base, and a mattress support frame (11) supported on said intermediate frame (10) comprising said center part (13), back part (14), thigh part (15), and lower leg part (16).

* * * * *